United States Patent [19]

Krivec et al.

[11] Patent Number: 4,643,010

[45] Date of Patent: Feb. 17, 1987

[54] TWO MOVEMENT TIME LOCK

[75] Inventors: Bert Krivec; Gary R. Murphree, both of Lexington; Walter R. Evans, Danville, all of Ky.

[73] Assignee: Sargent & Greenleaf, Inc., Nicholasville, Ky.

[21] Appl. No.: 715,962

[22] Filed: Mar. 25, 1985

[51] Int. Cl.[4] ..... E05B 43/00

[52] U.S. Cl. ..... 70/272

[58] Field of Search ..... 70/269, 272, 267, 268, 70/270, 271, 273, 274

[56] References Cited

U.S. PATENT DOCUMENTS 4,369,641 1/1983 Wallach ..... 70/272

4,412,436 11/1983 Bechtiger ..... 70/272

FOREIGN PATENT DOCUMENTS 2389736 1/1979 France ..... 70/448

*Primary Examiner*—Robert L. Wolfe

*Assistant Examiner*—Lloyd A. Gall

*Attorney, Agent, or Firm*—Mason, Fenwick & Lawrence

[57] ABSTRACT

A two movement time lock for bank vault doors and the like including a lock case for enclosing the timer units and a cover having transparent portions through which the dials of the timer units can be viewed. A pivoted integral locking lever of generally inverted distorted "T" shaped configuration has a pair of oppositely extending foot formations to be engaged and moved by trip formations of the timer units and a spring biased lever is interlinked with the locking lever above the pivot for normally positioning the locking lever at a cocked position when timer unit dials are displaced from the zero position. A pivoted snubber-bar blocking lever in the lock case is normally spring biased to a release position freeing a snubber bar to move to an unlocking position and a spring biased plunger has a first plunger position for forcing the blocking lever to snubber-bar blocking position and has a portion engagable by the locking lever for releasably restraining the plunger in such position when the locking lever is in cocked position.

17 Claims, 8 Drawing Figures

TWO MOVEMENT TIME LOCK

BACKGROUND AND OBJECTS OF THE INVENTION

The present invention relates in general to time locks, and more particularly to plural movement time locks for vaults, safes and other security containers.

Heretofore, time locks have been in common, widespread use to place bank vaults and similar safes, security spaces, and the like in a lock-out condition rendering them disabled from being opened in the normal way by bank personnel, as by proper dialing of a combination lock, during certain chosen times, such as between the bank closing time one day and its opening time the next day. In recent years, these time locks have customarily involved a box or case having two or three timer units or clockwork movements, to provide back-up redundancy in case one or two of the timer units fail, each of which has a settable dial graduated in hours and set from a key insertable into openings in the time lock case to indicate the desire locking hours or time lapse between setting of the timer and the time of opening of the vault the next working day. Each timer unit or movement customarily has a main spring and gear system to concurrently wind the main drive spring for the clockwork mechanism and drive the dial in a wind-up or increasing time lapse direction relative to a stationary pointer or index mark, and the dial usually has a trip pin or stub fixed on the dial face to engage an abutment surface on the end of a rigid arm extending from a movable carrier when the associated timer unit dial times out to zero time and move the carrier to a release position allowing a snubber bar connected in the usual manner to the bolts for the vault door, as by connection to a common control bar for the bolts, to retract to unlocking position. The carrier typically has three of such rigid arms extending to abutment ends located at the zero time positions for the trip pins of each of the three dials of the three timer units, so that any one of the three trip pins when it engages the abutment end surface of the associated extension arm of the carrier will push the carrier toward its release position by the force of the stored energy in the associated main drive spring to unlock the time lock.

Today, more and more security containers require time locks, to protect against hold-ups, minimize internal compromise by those knowledgeable of the safe combination or having access to the safe during non business hours, or in the case of home security container to provide additional protection during normal periods away from home. With the increased sophistocation of safe and burgular resistant designs, bolt-work and security re-lockers take up more room on a vault door or security closure, so that little room remains for a large three movement time lock of the type customarily used for vaults and large safes.

An object of the present invention is the provision of a time lock of reduced size which will take up considerably smaller space than the conventional three movement time lock and will fit virtually any security container, and which will be capable of being mounted in a number of different positions to make it applicable to a wide variety of security container situations.

A further object of the present invention is the provision of a novel two movement time lock for use on bank vaults and safes and a wide variety of other security containers, which has a quick mount modular design for low installation costs and will work on all types of doors, and which is virtually immune to vibration and impact attack and can operate in any position.

Yet another object of the present invention is the provision of a novel two movement time lock as described in the two immediately preceding paragraphs wherein a snap on housing cover is provided to facilitate ease of installation, with a mounting screw arrangement which is concentric, facilitating installation in mounting such as not to require left or right orientation when using a template for mounting, and wherein shock resistant and shock absorbent features are provided including resilient mounting components and geometry of the components is such as to minimize adverse vibration effects on the lock.

Other objects, advantages and capabilities of the present invention will become apparent from the following detailed description, taken in conjunction with the accompanying drawings illustrating a preferred embodiment of the invention.

DETAILED DESCRIPTION OF A PREFERRED EMBODIMENT

Figure 1:
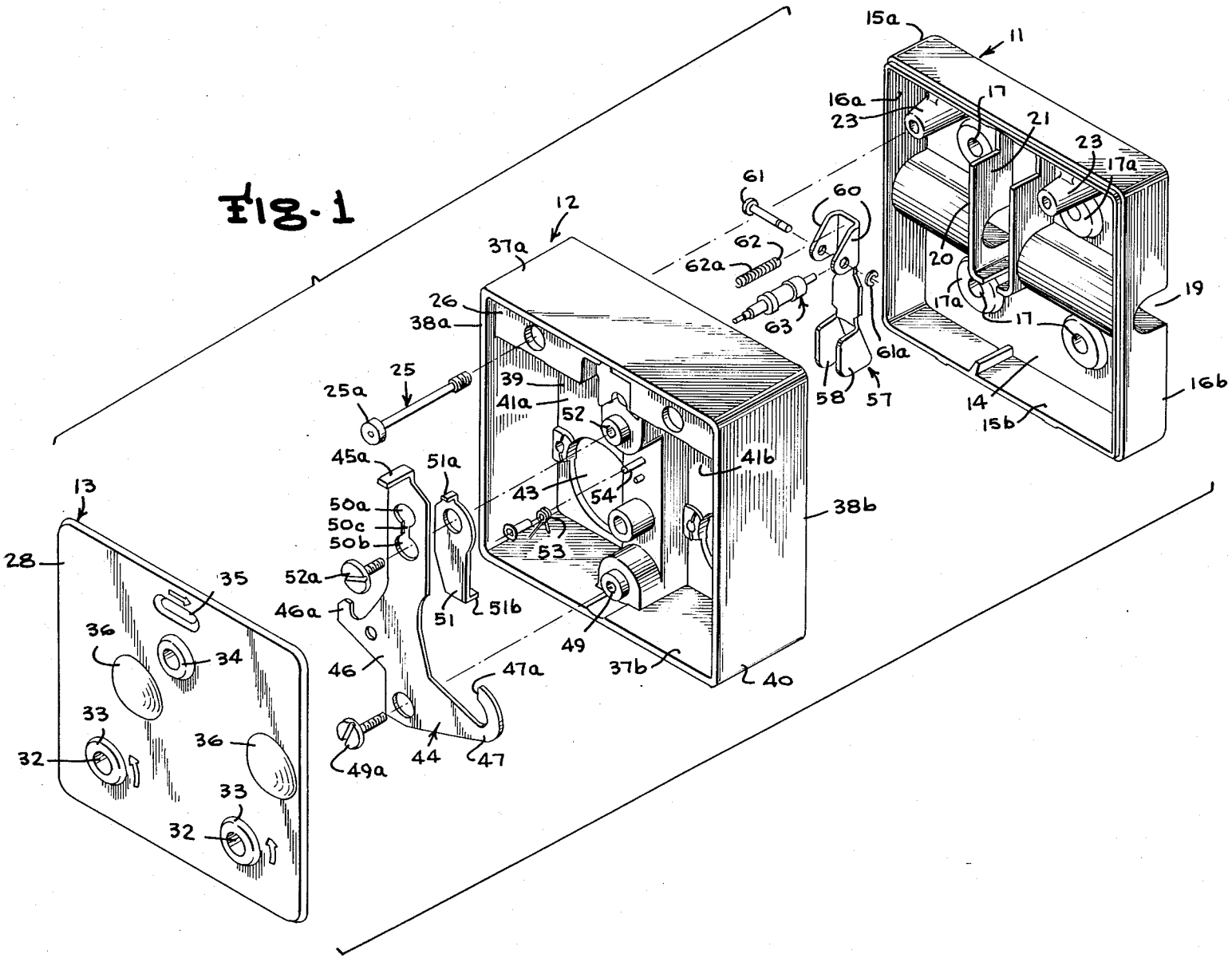
FIG. 1 is an exploded perspective view of the two movement time lock of the present invention, shown with the base, the lock housing and the transparent cover exploded from each other.
Figure 2:
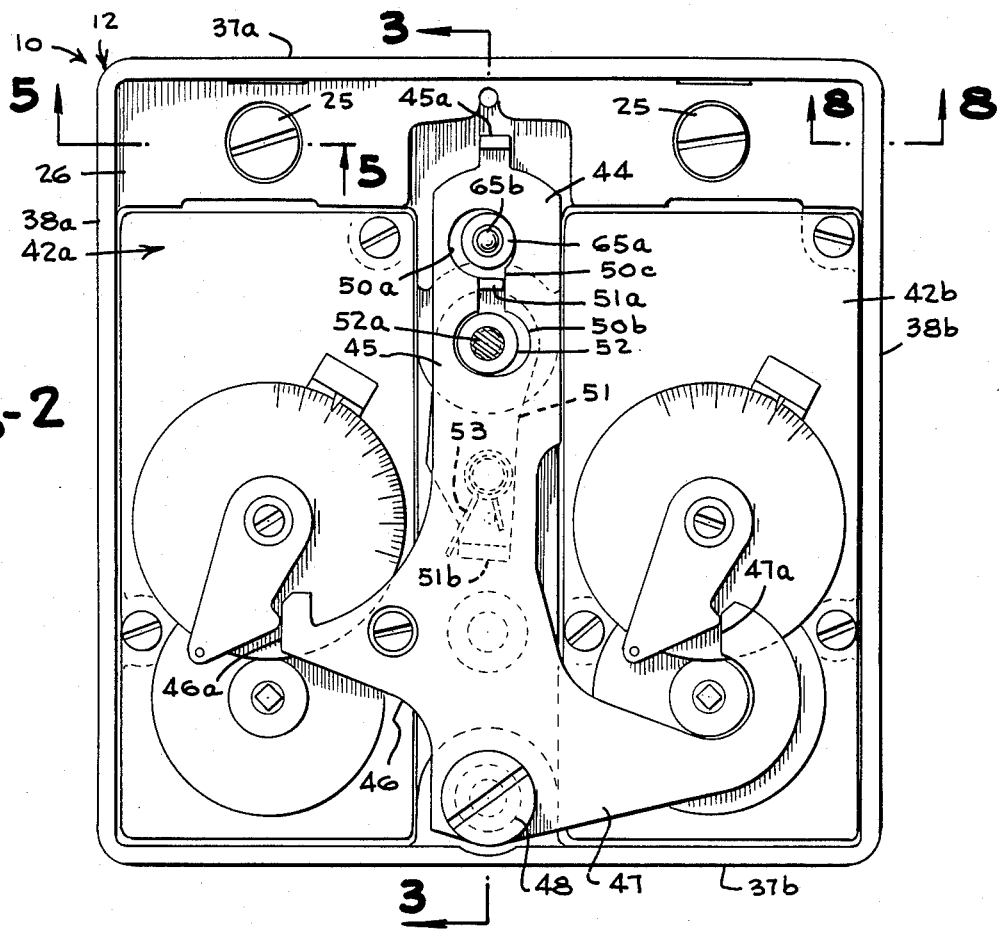
FIG. 2 is a front elevational view of the time lock with the front cover removed.
Figure 4:
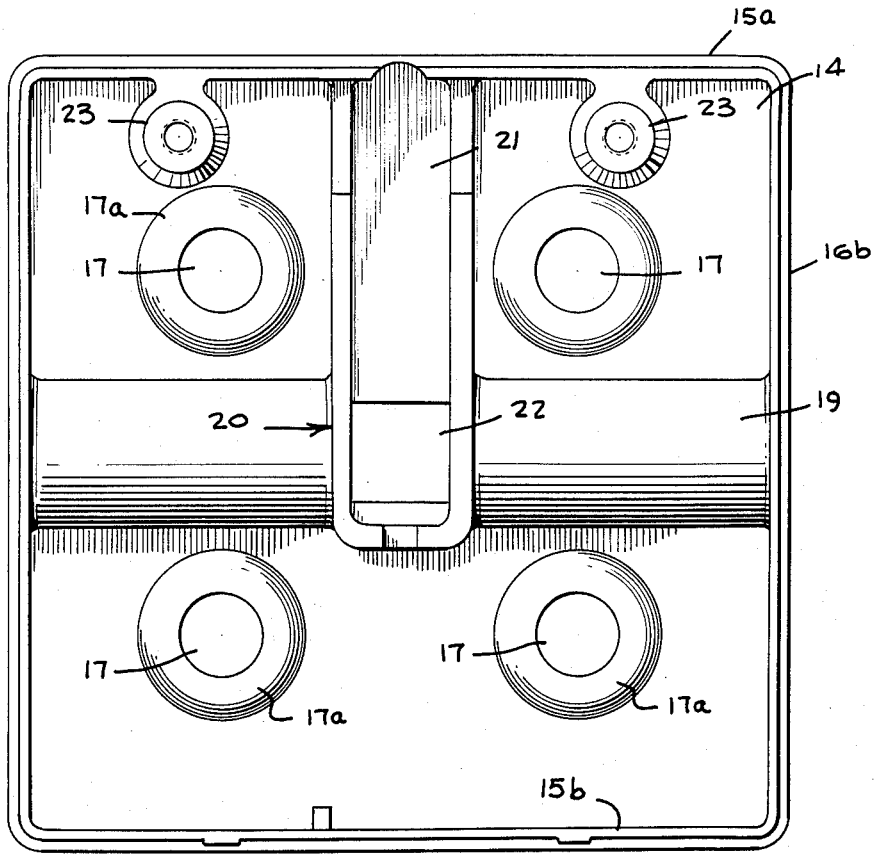
FIG. 4 is a front elevational view of the base component.

Referring to the drawings wherein like reference characters designate corresponding parts throughout the several figures, the two movement time lock of the present invention, indicated generally by the reference character 10 is of generally boxlike configuration resembling a rectangular solid and comprises three basic components, the base 11, the lock housing 12 and the cover 13. The base 11, which in one embodiment is of die cast zamak, serves as the mounting plate and, as is illustrated in FIG. 4 and the perspective view thereof in FIG. 1, as a generally flat rear wall portion 14 normally oriented in a vertical plane in use bounded at its vertical and horizontal edges by top and bottom side wall flanges 15*a*, 15*b* and vertical side wall flanges 16*a* and 16*b*, and having four concentrically located mounting bolt apertures 17 bounded by annular bosses or slightly protruding ring formations 17*a* to receive mounting screws 18 for fixing the base 11 against the wall of the vault door or security container closure. Each mounting screw 18 passes through a lock washer 18*a*, a mounting washer 18*b*, a gasket 18*c* and an annular shock absorbing mounting washer 18*d*. The base is shaped to define a snubber-bar receiving channel 19 which spans the width of the base 11 in its vertical mid region, the channel 19 opening rearwardly at the middle of the rear wall of the base and opening through the opposite side wall flanges 16*a*, 16*b*. Forwardly extending partition wall portions 20 collectively of generally U shaped configuration in rear elevation having long vertical legs define a forwardly opening channel or cavity 21 to receive the pivoted restrictor lever or bolt member, to be later described, and an opening 22 is provided in the base wall of the channel 21 in the zone where it intersects the channel 19 for a shoulder formation on the bolt member to extend into the snubber bar channel 19.

A pair of generally conically shaped coupling screw boss formations 23 molded integrally with the remaining portions of the base extend forwardly from the rear wall portion 14 near the top wall 15*a* to receive coupling screws 24 for fixing the lock housing component 12 on the base component 11. The forwardmost end portion of the coupling screw boss formation 23 provides a thickened coupling nut portion having an aperture 23*a* which is internally threaded to couple with the threads of the coupling screw or housing attaching screw 24 which extends through a rearwardly projecting boss formation 25 protruding from the front wall portion 26 of the lock housing component 12 and having a central bore 25*a* of somewhat larger diameter than the shank of the housing attaching screw 24 and of a length to butt against the forwardly facing end of the base component attaching screw boss formations 23 when the lock housing component 12 is in proper position against the base component 11. The enlarged heads 24*a* of the attaching screws 24 are of larger diameter than the diameter of the bores 25*a* so that they butt against the front face of the front wall portion 26 of the lock housing 12.

Figure 8:
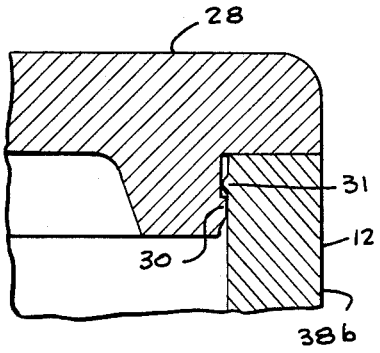
FIG. 8 is an enlarged fragmentary section view through an edge portion of the case and housing showing the formations for assembling the snap on cover on the case or housing.
Figure 6:
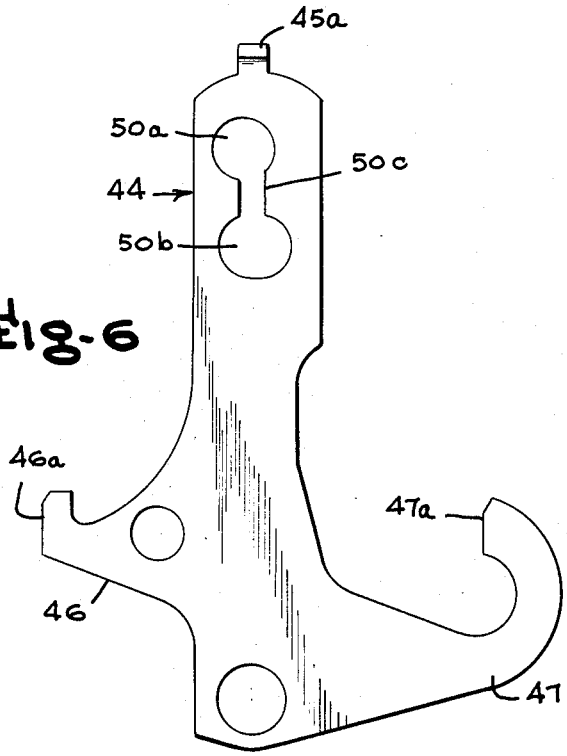
FIG. 6 is a front elevational view of the locking lever.
Figure 7:
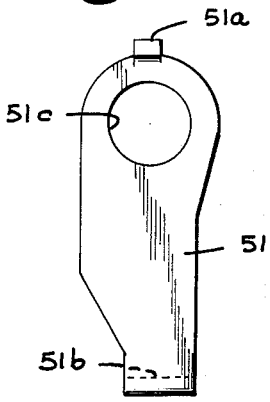
FIG. 7 is a front elevational view of the spring arm member linked with the locking lever.

The cover component 13 is a relatively thin rectangular body, which in the illustrated embodiment is made of a clear, light transmissive type of nylon, which provides increased chemical resistance over polycarbonates previously normally used for clear plastic covers on lenses. The transparent cover member 13 is an integrally molded plastic member having a front wall 28 rounded at its corners, of rectangular front elevation, provided with an uninterrupted lip or rib formation 29 around its perimeters spaced slightly inwardly from the outer periphery and provided with a plurality of integral retaining bead formations 30 (see FIG. 8) having a rearwardly facing inclined ramp configuration and a forwardly spacing rounded restraining shoulder to coact with similar retaining bead formations 31 on the lock housing case 12 to provide the snap on action desired. The transparent front cover member has a pair of apertures 32 to receive the keys for winding the timer units as later described and as is customary in time locks, bounded by annular thickened collar formations 33, each having a shoulder 33*a* for a winding key "stop" and an opening 34 and transversely elongated slot 35 are provided in the cover member near the top, the opening 34 being also bounded by a thickened collar formation 34*a*, for respectively receiving therethrough a part of the plunger assembly or the locking lever release tab as later described. The front cover may also include a pair of spherical dome like protrusions 36 molded in the plastic material by providing convex spherical thickened portions to form magnifying lenses over the fixed index and adjacent portions of the timer units, later described to facilitate reading the numerals on the time unit dials.

The lock housing or case component 12 is a boxlike structure having upper and lower sidewalls 37*a*, 37*b* and vertical parallel sidewalls 38*a*, 38*b* forming the side surround structure and having an irregular intermediate partition wall 39 defining selected forwardly and rearwardly opening cavities of desired shape, all molded, in the preferred embodiment, of a mineral reinforced nylon having good chemical resistence properties, high melting point, low warpage and good dimensional stability. The molded lock housing body indicated generally by the reference character 40, is of the same vertical and horizontal dimensions as the base component 11 and the cover component 13 forming the other two of the three modules of the time lock, and the lock housing body 40 is designed to be removably secured to the base 11 by two attaching screws, previously identified as the attaching screws 24, whose shafts or stems extend through the rearwardly projecting hollow bosses 25 formed integrally with the partition wall portion 26 transversely spanning the lock housing body along the upper portion thereof to securely fix the lock housing module or component 12 to the base module or component 11 after the latter has been installed in proper position on the vault or safe door or other security container closure.

The molded lock housing body 40 is provided with two forwardly opening generally rectangular wells 41*a*, 41*b* spaced transversely of the lock housing body to provide a zone between the two wells 41*a*, 41*b* to receive the pivoted bolt member, to be later described, and is shaped to receive in nested relation therein the two timer mechanism assemblies, customarily referred to timer movements, indicated herein by the reference characters 42*a* and 42*b*. The rear wall portions of the two wells 41*a*, 41*b* are provided with circular through apertures 43 to receive the conventional spring housing portion of the timer movements 42*a*, 42*b*. The timer movements 42*a*, 42*b* may be of the conventional type shown for example in earlier Sargent & Greenleaf, Inc. U.S. Pat. No. 4,062,210, wherein the dial member with the forwardly facing numerical indicia indicating hours carries a rigid trip pin of cylindrical shape, or may be a timer movement of the kind disclosed in Sargent & Greenleaf, Inc. U.S. Pat. No. 4,269,050, having a kicker arm mechanism forwardly adjacent and associated with the dial to be abruptly kicked by spring force against a shoulder of the locking lever for the two movement timer lock.

The locking lever for the time lock mechanism is indicated by the reference character 44 and is of an inverted, highly distorted "T" shaped configuration having a vertically extending primary lever arm 45 and a pair of oppositely extending lower legs 46, 47 adapted to lie forwardly adjacent the dials of the two timer movements 42*a*, 42*b*. The locking lever 44 is pivoted adjacent its lower end, as indicated at 48, by a pivot boss 49 received in a circular aperture in the upper portion of the lever arm 45 of locking lever 44 and is retained thereon by a screw 49*a* tapped into the center opening of the boss 49. The locking lever includes a pair of shaped, generally round apertures 50*a*, 50*b* which in the illustrated embodiment are connected by passage 50*c* forming a generally dumbbell configuration, the upper aperture 50*a* being substantially circular and the lower aperture 50*b* being somewhat enlarged horizontally producing an oval shape with its major axis extending horizontally. The uppermost end portion of the locking lever 44 includes a rigid forwardly extending release tab 45*a* which projects through the tranversely elongated slot 35 of the cover 13 for manual activation to override the locked condition of the lever and effect emergency release of the time lock.

It will be noted that the shorter leg 46*a* extending to the left of the primary lever arm 45 of the locking lever, when viewed from the front, has an abutment shoulder 46*a* at the end portion thereof to be contacted and activated by the release pin or kicker arm associated with the dial of the left hand timer movement 42*a*, while the longer locking lever leg 47 has a recurved generally hook shaped or "U" shaped end portion 47*a* which forms the abutment surface for activation by the trip pin or kicker arm associated with the right hand timer movement 42*b*.

Figure 3:
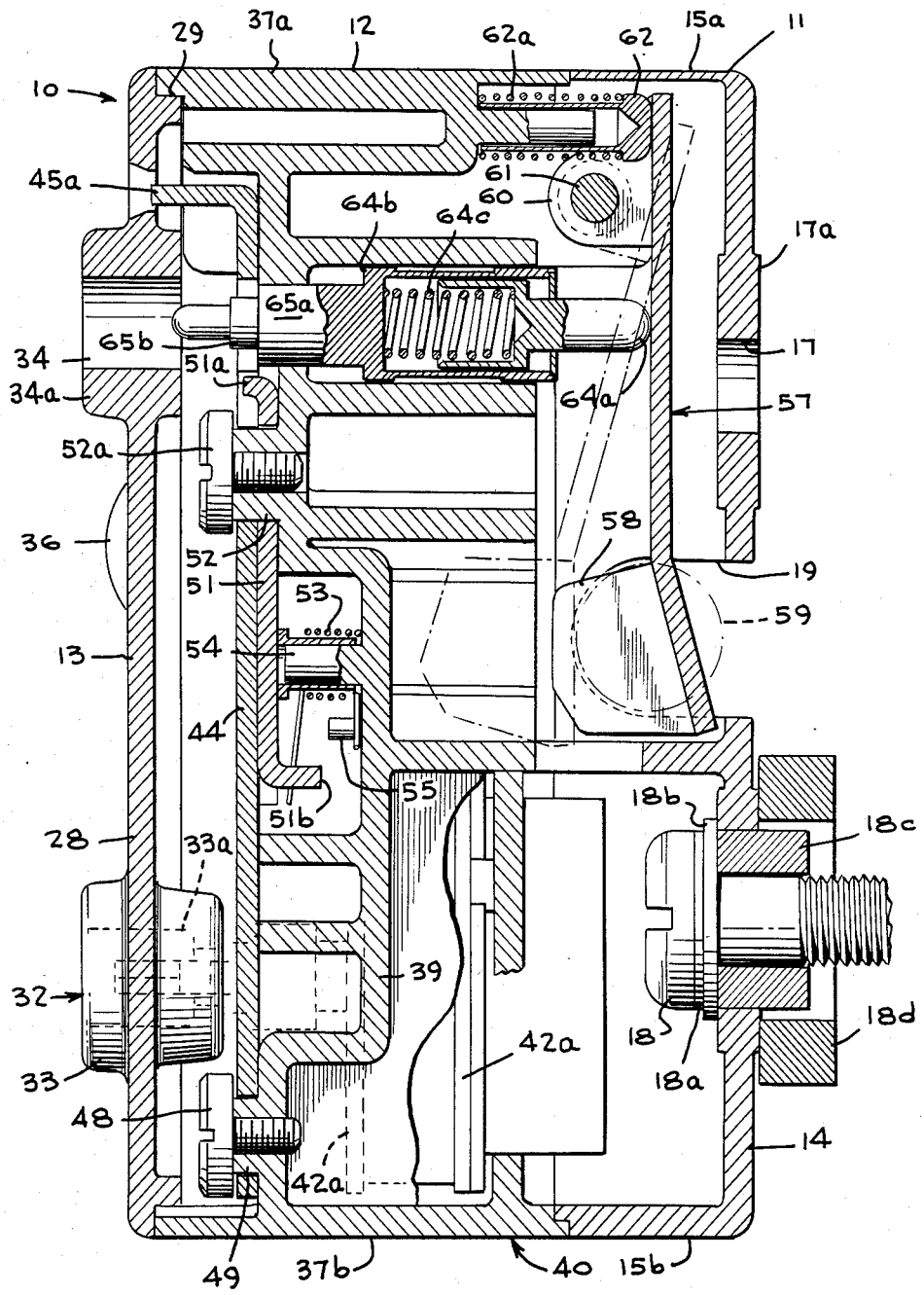
FIG. 3 is a vertical section view of the time lock assembly, taken along the line 3—3 of FIG. 2.
Figure 5:
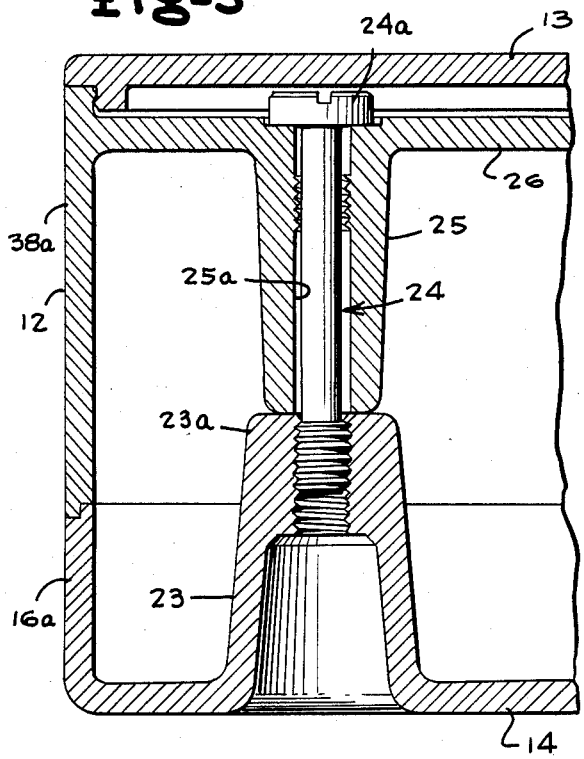
FIG. 5 is a fragmentary section view taken along the line 5—5 of FIG. 2 showing details of the mounting screw and associated formations for assembling the housing to the base.

Associated with the locking lever 44 is a spring arm member 51 which is disposed rearwardly adjacent the locking lever 44, as illustrated in FIG. 3, and includes a forwardly projecting upper end tab 51*a*, a rearwardly projecting lower end tab 51*b*, and has an aperture 51*c* of circular configuration sized to fit on and rotate about the forwardly projecting boss 52 which also projects through the laterally enlongated slot aperture 50*b* of the locking lever 44. The lower end tab formation 51*b* of the spring arm member 51 is engaged by the projecting end portion of a torsion spring 53 wound about a post formation 54 of the center portion of the lock housing member 40 and having its opposite end restrained by a stop 55. The spring arm member 51 and the upper portion of the locking lever arm 45 are captured by the screw 52*a* threaded into the center opening of the boss formation 52. As will be seen from FIG. 3, the upper forwardly projecting tab 51*a* of the spring arm member 51 extends into the connecting slot or passage 50*c* interconnecting the apertures 50*a*, 50*b* in the locking lever arm 45, interlinking these two lever members 44 and 51 so that they move, in effect, in opposite directions and form a spring activated overcenter mechanism.

A snubber blocking restrictor lever 57 is received in the central vertically extending channel 21 intersecting the snubber bar channel 19 of the base component 11 and includes blocking abutments or shoulder formations 58 at its lower end, producing a "U" shaped or channel configuration at the lower end, which normally occupies the snubber bar channel 19 blocking the mid portion of the channel 19 so that the snubber bar, indicated in broken lines at 59, is blocked in its outwardly projecting or locking position. As will be understood by those skilled in the art, the snubber bar is usually installed on the door or wall of the safe or vault and is connected to the customary control bar coordinating locking and unlocking movement of the door bolts into and withdrawal from sockets in the door jamb portions. Near the upper end of the restrictor lever 57 are a pair of forwardly projecting pivot ears 60 mounted on a pivot pin 61 removably fixed in the housing component 12, and the portion of the restrictor lever 57 projecting above the pivot pin 61 restrained by snap ring member 61*a*, forms an abutment engaged by a bolt plunger 62 and associated bolt plunger spring 62*a* continuously biasing the restrictor lever 57 in a clockwise direction to the snubber bar releasing position shown in broken lines in FIG. 3. The restrictor lever 57 is normally restrained in the rearward blocking position shown in solid lines in FIG. 3, however, by the restrictor control plunger assembly 63 comprising relatively movable telescoping plunger components 64 a, 64*b* having a coil spring 64*c* housed within the components 64*a*, 64*b* biasing them in opposite directions.

The rearmost end of the plunger component 64*a* abuts rearwardly against the restrictor lever 57 at a location between the pivot pin 61 and the blocking formation 58. The forward portion of the plunger component 64*b* has a cylindrical portion of an intermediate diameter 65*a* corresponding substantially in diameter to the circular opening 50*a* in the locking lever 44 to be received therein and having a smaller diameter cylindrical portion 65*b* projecting forwardly from the intermediate diameter portion 65*a* to be received in the locking lever opening 50*a* in the locked position of the time lock with the transition surface between the portion 65*a* and 65*b* rearwardly abutting portions of the locking lever bounding the opening 50*a*. The plunger opening 34 in the front cover 13 registers with the restrictor control plunger assembly 63 permitting finger access to engage and shift the plunger forward component 64*b* to the locked position locating the smaller diameter portion 65*b* in the locking lever opening 50*a* with the transition surface at the rear thereof abutting the rearwardly facing surface of the locking lever to set the time lock to the snubber bar blocking or locked position.

The time lock is installed on the safe door or vault by the mounting screws 18 and their associated washers including the shock absorbing annular washers 18*d*, with the snubber bar channel 19 aligned to receive the snubber bar. When the channel 19 is clear of the blocking abutment portion 58 of the restrictor lever 57, permitting axial movement of the snubber bar 59 to the unlocking position, setting of the lock is initiated by inserting the proper timer movement winding key into the openings 32 to engage the key with the winding stem of the spring for the associated timer movement, in the usual manner, and the key is rotated to drive the dial of the timer movement to the proper indicated position with the usual fixed index mark, viewable through the lens formation 36, to set the proper time lapse. This frees the locking lever 44 to be moved clockwise about the pivot forming boss formation 52 under the action of the torsion spring 53 and the spring arm member 51 to the cocked position, upon manual depressing of the restrictor control plunger assembly 63 to the inward restraint position where the transition surface shoulder between the smaller diameter portion 65*b* and the larger diameter portion 65*a* moves flush with the rear face of the locking lever arm 45 and is latched in the rearwardly stressed position by portions of the locking lever arm 45 bounding the opening 50*a*. In this position of the restrictor control plunger assembly 63, the rearward plunger component and the action of the spring 64*c* overcome the spring force of the bolt plunger 62 and its spring 62*a* and position the restrictor lever 57 in the rearward position shown in solid lines in FIG. 3 where the blocking abutment portion 58 blocks the snubber bar channel 19 and restrains the snubber bar in vault door locking position.

When the timer movements 42*a*, 42*b* wind down to the zero position, the trip pin on the dial, or the kicker arm lever forwardly adjacent the dial, of each timer movement engages the abutment surface 46*a* of the leg 46 and the abutment surface 47*a* of the curved leg 47 of the locking lever 44, shifting the lever 44 about its pivot boss 49, overcoming the biasing effect of the spring arm member 51 and its spring 53 linked to the locking lever through the tab 51*a* interfitting in the slot 50*c*. The consequent transverse movement of the upper portions of the locking lever arm 45 permitted by the oval shape of the aperture 50*b* moves the locking lever upper portions sufficiently to center the circular opening 50*a* relative to the center axis of the forward plunger component 64*b* permitting the intermediate diameter portion 65*a* thereof to snap forwardly under the force of spring 64*c* to the release position and permitting the spring 62*a* and plunger 62 engaging the top portion of the restrictor lever 57 to swing the restrictor lever 57 forwardly to the release position shown in broken lines in FIG. 3.

I claim:

1. A time lock for bank vault doors and the like comprising a lock case for enclosing a plurality of timer units of the settable dial type with a clockwork mechanism and associated locking mechanisms and a cover having transparent portions through which the dials of the timer units can be viewed, the dials of the timer units having a zero position and being rotatable about parallel axes and each including trip means associated therewith adapted to reach a trip position when the timer unit has timed out the desired time period, a pivoted locking lever of generally inverted distorted "T" shaped configuration having a vertically elongated arm pivoted near its lowermost end for movement about an axis paralleling the axes of the timer unit dials and having a pair of oppositely extending foot formations terminating in abutment surfaces to be engaged and moved by said trip means upon reaching the trip position, spring biased lever means interlinked with said locking lever at a location along the arm portion thereof spaced upwardly from the pivot therefor for normally positioning the locking lever at a cocked position when the trip means of the timer unit dials are displaced from the zero position, a pivoted snubber-bar blocking lever in the lock case normally spring biased by first spring means to a release position freeing a snubber bar to move to an unlocking position, spring biased plunger means in the case biased to engage the blocking lever having a first plunger position for overcoming the spring force of the first spring means and forcing the blocking lever to snubber-bar blocking position and having a portion engagable by the locking lever for releasably restraining the plunger in its position when the locking lever is in cocked position, and said locking lever having means movable to a released position releasing said plunger means from said first position to free said first spring means to move the blocking lever to snubber bar releasing position when the locking lever is displaced from cocked position to released position by engagement with said trip means of said timer units.

2. A time lock for bank vault doors and the like as defined in claim 1, wherein said lock case has a horizontal channel for receiving a snubber bar therein, said blocking lever being a vertically elongated member pivoted near but spaced from its uppermost end for movement about a horizontal axis and having a portion projecting above the pivot and having a blocking enlargement at its lowermost end for movement into blocking relation in said channel and for retraction therefrom, said first spring means comprising a spring plunger assembly carried in the lock case and engaging the upper end portion of the blocking lever projecting above said pivot.

3. A time lock for bank vault doors and the like as defined in claim 2, wherein said lock case is formed of three module components made up of a rearmost base component, an intermediate lock housing component for housing the timer units and associated locking mechanism and a forwardmost transparent cover component, the base component having mounting screw holes located concentrically relative to the center thereof permitting mounting of the base against the bank vault door or the like in either left hand or right hand positions, the intermediate lock housing component being removably assembled to the base component by mounting screws, and the cover component being removably assembled to the intermediate housing component by snap on bead formations on confronting surfaces thereof for snap on assembly and removal of the cover component.

4. A time lock for bank value doors and the like as defined in claim 2, wherein said spring biased plunger means includes a forwardly spring biased larger diameter cylindrical formation and a smaller diameter cylindrical formation joined thereto by a transition surface, and said locking lever having a first circular opening therein approximating the diameter of said larger cylindrical plunger portion to receive the latter therein at the released position of said plunger means and said locking lever at said cocked position receiving said smaller diameter cylindrical portion of the plunger means therein with bounding surface portions at the opening engaging said transition surface to restrain the plunger means in said first plunger position.

5. A time lock for bank vault doors and the like as defined in claim 4, wherein said locking lever has a second round opening therein of horizontally enlarged oval configuration having major and minor axes adjacent and below said first round opening in the locking lever and the lock housing having a fixed cylindrical boss of a diameter corresponding to the minor axis diameter of said second round opening with the major axis diameter portion of said round opening accommodating a limited amount of transverse tilting movement of the portions of the locking lever having said openings permitting movement of the locking lever between its locking and releasing positions.

6. A time lock for bank vault doors and the like as defined in claim 5, wherein said locking lever includes a slot interconnecting said first and second openings of smaller transverse width than the diameters of said openings and said spring biased lever means is pivoted on said boss extending through said second opening of the locking lever and includes a forwardly projecting end tab at its upper end extending into said slot and having a width corresponding substantially to the width of the slot for interlinking the spring biased lever means and said locking lever.

7. A time lock for bank vault doors and the like as defined in claim 4, wherein said lock base is formed of three module components made up of a rearmost base component, an intermediate lock housing component for housing the timer units and associated locking mechanism and a forwardmost transparent cover component, the base component having mounting screw holes located concentrically relative to the center thereof permitting mounting of the base against the bank vault door or the like in either left hand or right hand positions, the intermediate lock housing component being removably assembled to the base component by mounting screws, and the cover component being removably assembled to the intermediate housing component by snap on bead formations on confronting surfaces thereof for snap on assembly and removal of the cover component.

8. A time lock for bank vault doors and the like as defined in claim 2, wherein said locking lever has a second round opening therein of horizontally enlarged oval configuration having major and minor axes adjacent and below said first round opening in the locking lever and the lock housing having a fixed cylindrical boss of a diameter corresponding to the minor axis diameter of said second round opening with the major axis diameter portion of said round opening accommodating a limited amount of transverse tilting movement of the portions of the locking lever having said openings permitting movement of the locking lever between its locking and releasing positions.

9. A time lock for bank vault doors and the like as defined in claim 8, wherein said locking lever includes a slot interconnecting said first and second openings of smaller transverse width than the diameters of said openings and said spring biased lever means is pivoted on said boss extending through said second opening of the locking lever and includes a forwardly projecting end tab at its upper end extending into said slot and having a width corresponding substantially to the width of the slot for interlinking the spring biased lever means and said locking lever.

10. A time lock for bank vault doors and the like as defined in claim 1, wherein said spring biased plunger means includes a forwardly spring biased larger diameter cylindrical formation and a smaller diameter cylindrical formation joined thereto by a transition surface, and said locking lever having a first circular opening therein approximating the diameter of said larger cylindrical plunger portion to receive the latter therein at the released position of said plunger means and said locking lever at said cocked position receiving said smaller diameter cylindrical portion of the plunger means therein with bounding surface portions at the opening engaging said transition surface to restrain the plunger means in said first plunger position.

11. A time lock for bank vault doors and the like as defined in claim 10, wherein said lock case is formed of three module components made up of a rearmost base component, an intermediate lock housing component for housing the timer units and associated locking mechanism and a forwardmost transparent cover component, the base component having mounting screw holes located concentrically relative to the center thereof permitting mounting of the base against the bank vault door or the like in either left hand or right hand positions, the intermediate lock housing component being removably assembled to the base component by mounting screws, and the cover component being removably asembled to the intermediate housing component by snap on bead formations on confronting surfaces thereof for snap on assembly and removal of the cover component.

12. A time lock for bank vault doors and the like as defined in claim 10, wherein said locking lever has a second round opening therein of horizontally enlarged oval configuration having major and minor axes adjacent and below said first round opening in the locking lever and the lock housing having a fixed cylindrical boss of a diameter corresponding to the minor axis diameter of said second round opening with the major axis diameter portion of said round opening accommodating a limited amount of transverse tilting movement of the portions of the locking lever having said openings permitting movement of the locking lever between its locking and releasing positions.

13. A time lock for bank vault doors and the like as defined in claim 12, wherein said locking lever includes a slot interconnecting said first and second openings of smaller transverse width than the diameters of said openings and said spring biased lever means is pivoted on said boss extending through said second opening of the locking lever and includes a forwardly projecting end tab at its upper end extending into said slot and having a width corresponding substantially to the width of the slot for interlinking the spring biased lever means and said locking lever.

14. A time lock for bank vault doors and the like as defined in claim 1, wherein said locking lever has a second round opening therein of horizontally enlarged oval configuration having major and minor axes adjacent and below said first round opening in the locking lever and the lock housing having a fixed cylindrical boss of a diameter corresponding to the minor axis diameter of said second round opening with the major axis diameter portion of said round opening accommodating a limited amount of transverse tilting movement of the portions of the locking lever having said openings permitting movement of the locking lever between its locking and releasing positions.

15. A time lock for bank vault doors and the like as defined in claim 14, wherein said locking lever includes a slot interconnecting said first and second openings of smaller transverse width than the diameters of said openings and said spring biased lever means is pivoted on said boss extending through said second opening of the locking lever and includes a forwardly projecting end tab at its upper end extending into said slot and having a width corresponding substantially to the width of the slot for interlinking the spring biased lever means and said locking lever.

16. A time lock for bank vault doors and the like as defined in claim 14, wherein said lock case is formed of three module components made up of a rearmost base component, an intermediate lock housing component for housing the timer units and associated locking mechanism and a forwardmost transparent cover component, the base component having mounting screw holes located concentrically relative to the center thereof permitting mounting of the base against the back vault door or the like in either left hand or right hand positions, the intermediate lock housing component being removably assembled to the base component by mounting screws, and the cover component being removably assembled to the intermediate housing component by snap on bead formations on confronting surfaces thereof for snap on assembly and removal of the cover component.

17. A time lock for bank vault doors and the like as defined in claim 1, wherein said lock case is formed of three module components made up of a rearmost base component, an intermediate lock housing component for housing the timer units and associated locking mechanism and a forwardmost transparent cover component, the base component having mounting screw holes located concentrically relative to the center thereof permitting mounting of the base against the bank vault door or the like in either left hand or right hand positions, the intermediate lock housing component being removably assembled to the base component by mounting screws, and the cover component being removably assembled to the intermediate housing component by snap on bead formations on confronting surfaces thereof for snap on assembly and removal of the cover component.

* * * * *